US006055959A

United States Patent [19]

Taue

[11] Patent Number: 6,055,959

[45] Date of Patent: May 2, 2000

[54] ENGINE SUPERCHARGED IN CRANKCASE CHAMBER

[75] Inventor: Jun Taue, Iwata, Japan

[73] Assignee: Yamaha Hatsudoki Kabushiki Kaisha, Japan

[21] Appl. No.: 08/943,640

[22] Filed: Oct. 3, 1997

[51] Int. Cl.[7] ..... F02B 75/02

[52] U.S. Cl. ..... 123/317; 123/318; 123/568.12

[58] Field of Search ..... 123/317, 318, 123/316, 568.12, 568.13

[56] References Cited

U.S. PATENT DOCUMENTS

| | | | |
|---|---|---|---|
| 1,530,864 | 3/1925 | Vaughan | 123/568.13 |
| 3,973,532 | 8/1976 | Litz | 123/317 |
| 4,282,845 | 8/1981 | Nohira et al. | 123/568.13 |
| 5,230,314 | 7/1993 | Kawahara et al. | 123/317 |
| 5,377,634 | 1/1995 | Taue . | |
| 5,657,724 | 8/1997 | Brown et al. | 123/317 |
| 5,660,155 | 8/1997 | Taue et al. . | |
| 5,678,525 | 10/1997 | Taue . | |
| 5,709,186 | 1/1998 | Taue . | |
| 5,778,838 | 7/1998 | Taue | 123/318 |

*Primary Examiner*—John Kwon
*Attorney, Agent, or Firm*—Kobbe, Martens, Olson & Bear, LLP

[57] ABSTRACT

Several embodiments of crankcase compression supercharged four-cycle internal combustion engines. Supercharger pressure is controlled by bypassing pressurized gases from the crankcase back to the crankcase downstream of a check valve that permits flow into the crankcase so as to avoid the escape of pressurized gases to the atmosphere and to reduce pumping losses and improve performance. Various positioning of the components is illustrated. Also, an improved and simplified internal EGR system is employed.

23 Claims, 9 Drawing Sheets

ENGINE SUPERCHARGED IN CRANKCASE CHAMBER

BACKGROUND OF THE INVENTION

This invention relates to a four-cycle crankcase compression engine and more particularly to an improved pressure-controlling and throttling arrangement for such engines as well as an improved EGR system for controlling nitrous oxide ($NO_x$) emissions.

It has been proposed to form a four-cycle internal combustion engine in such a manner that the crankcase chamber serves as a compression chamber for compressing the charge that is delivered to the induction system. Several very effective embodiments for achieving this purpose are shown in my U.S. Pat. No. 5,377,634, issued Jan. 3, 1995 and entitled "Compressor System For Reciprocating Machine," which patent is assigned to the assignee hereof.

In that patent and in other instances, an arrangement has been incorporated for limiting the maximum boost pressure by bypassing a portion of the compressed charge back to the intake side upstream of the point of admission to the crankcase chamber. Although this arrangement has some advantages, it also has some disadvantages.

First, by passing the pressurized charge back to the induction system upstream of the crankcase chamber, the actual pressure in the induction system varies. This can give rise to problems on deceleration and may, in some instances, provide erratic operation. This is particularly true if the charge former is placed in the induction system. The varying pressure in the induction system can cause erratic performance of the charge former and/or even reverse flow of the gases to the atmosphere.

This problem in connection with the charge former can be avoided, of course, by locating the charge former on the downstream side. However, if this is done, there is still a problem in that the engine experiences high pumping losses. Also, the throttle arrangement utilized in that type of device does not permit as wide a control over engine running as may be desired.

It is, therefore, a principal object of this invention to provide an improved pressure control system for a four-cycle engine embodying crankcase compression.

It is a further object of this invention to provide an improved pressure control system for a crankcase compression four-cycle engine.

In conjunction with engine operation, there is increased emphasis on the controlling of the emission of gasses, particularly from the exhaust of the engine, that may have some undesirable effects. One of these gasses are oxides of nitrogen, referred to commonly as $NO_x$. $NO_x$ results from high temperatures in the combustion chamber that cause oxides of nitrogen to form. One way of combating the formation of $NO_x$ is through the use of an exhaust gas recirculation (EGR) arrangement. That is, under some running conditions when nitrous oxides may be generated, the combustion temperature is lowered by recycling exhaust gasses into the combustion chamber.

Although this method of controlling $NO_x$ is effective, it has resulted in very complicated arrangements. That is, it is necessary to collect the exhaust gasses, generally in the exhaust system, and re-convey them to the cylinder. It is important that each cylinder receive the appropriate amount of exhaust gas recirculation. This obviously results in the use of considerable plumbing and control valves.

It is, therefore, a further principal object of this invention to provide an improved and simplified EGR system for engines.

It is a still further object of this invention to provide an EGR system for engines wherein the EGR system is basically internal and requires no valves or significant external conduits. In addition, the ideal system would serve each cylinder individually.

As will become apparent from the following description, this object is accomplished by providing an EGR accumulator device that communicates with each individual cylinder of the engine through a communication port in the cylinder bore. The communication port is positioned so that it is uncovered only when the piston is near its bottom dead center position. In this way, the exhaust gasses can accumulate in the accumulator chamber and be released during the intake stroke for internal exhaust gas recirculation.

One problem with such an arrangement is the positioning of the port for the exhaust gas accumulator chamber may be uncovered to the crankcase at times or may be disposed in a location so that lubricant can flow into proximity with the communication port. The port should, of course, be relatively small in size, and this gives rise to the possibility of deposits being formed and blocking the port from carbonization of the lubricant.

It is, therefore, a still further object of this invention to provide an internal EGR system for an engine wherein the porting and lubrication system is arranged in such a manner that the port will not easily become clogged.

SUMMARY OF THE INVENTION

A first feature of this invention is adapted to be embodied in four-cycle, crankcase compression, internal compression engine. The engine is comprised of a cylinder block defining at least one cylinder bore. A cylinder head is affixed to the cylinder block in closing relation to one end of the cylinder bore and forms a combustion chamber with the cylinder bore. A crankcase member is affixed to the cylinder block in closing relation to the other end of the cylinder bore and forms a crankcase chamber with the cylinder block. A piston reciprocates in the cylinder bore and divides the combustion chamber from the crankcase chamber. This piston drives a crankshaft that is rotatably journaled in the crankcase chamber. Timed intake and exhaust valves permit a charge to enter the combustion chamber and permit a burnt charge to be discharged from the combustion chamber. An intake charge is delivered to the crankcase chamber from an atmospheric air inlet for admitting atmospheric air to the crankcase chamber for compression therein. A first control valve controls the communication of the atmospheric air with the crankcase chamber so that air can only enter the crankcase chamber from the atmospheric air inlet. A second control valve controls the communication of the crankcase chamber with a pressure chamber so as to permit a charge that is compressed in the crankcase chamber to flow from the crankcase chamber to the pressure chamber but for precluding flow back into the crankcase chamber. A pressure passage communicates the pressure chamber with the intake valve. A supercharger throttle valve controlled bypass passage extends from the pressure chamber to the crankcase chamber at a point between the two control valves for controlling the maximum pressure in the pressure passage.

Another feature of the invention is adapted to be embodied in an EGR system for an internal combustion engine having a cylinder block that defines a cylinder bore. A piston reciprocates in the cylinder bore and forms with the cylinder bore and the cylinder head a variable volume chamber in which combustion occurs. An exhaust gas recirculation accumulator chamber communicates with the combustion chamber through a port opening in the cylinder bore. The port opening is disposed in proximity to the bottom dead center position of the piston so that the exhaust gas recirculation accumulator chamber communicates with the combustion chamber only when the piston is at or near its bottom dead center position.

In accordance with a further feature of the invention, lubricant is delivered to the cylinder bore but is delivered in such a manner so that the lubricant delivery is well spaced from the port that communicates the exhaust gas recirculation accumulator chamber with the cylinder bore.

DETAILED DESCRIPTION OF THE PREFERRED EMBODIMENTS

Figure 1:
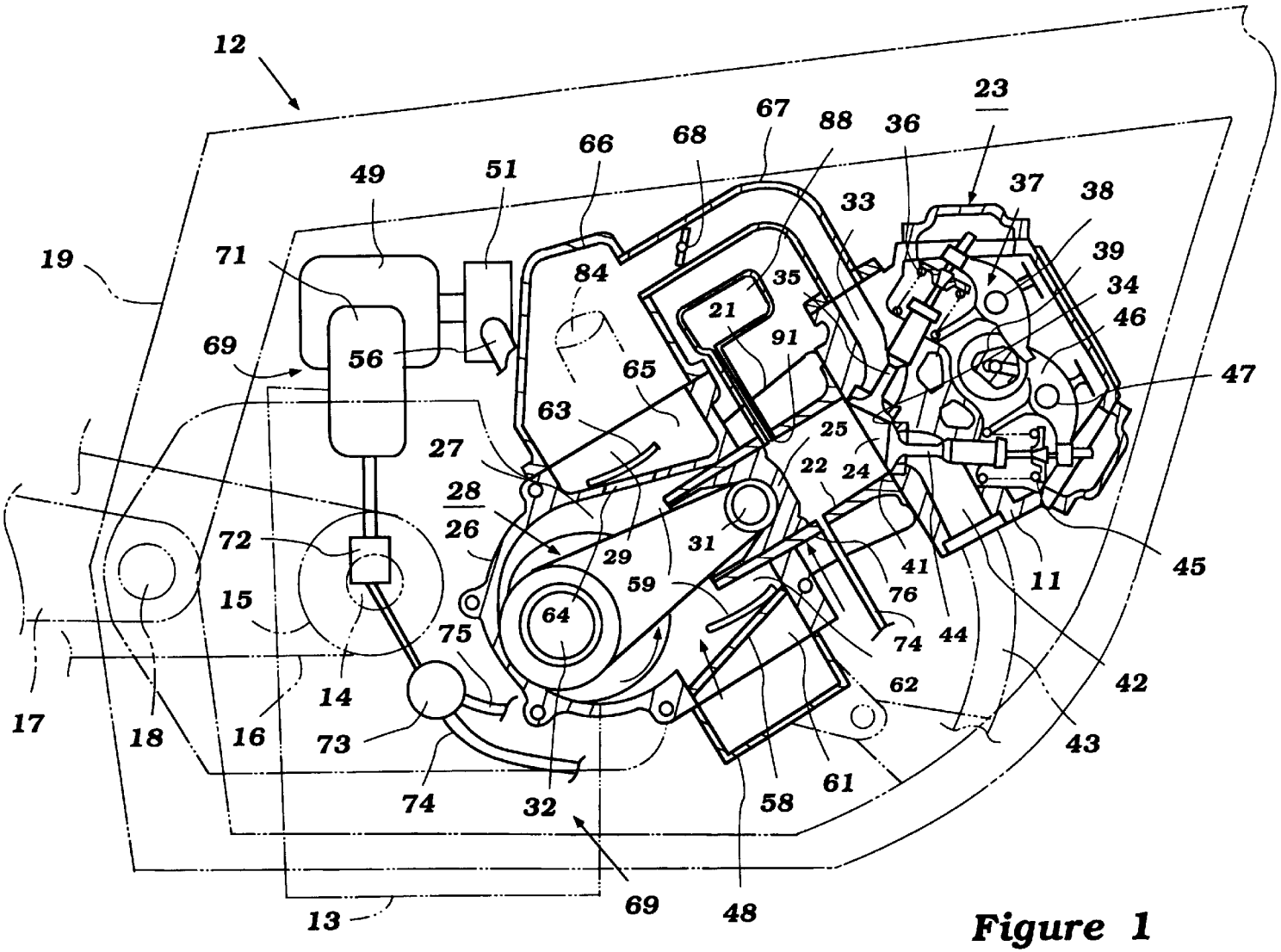
FIG. 1 is a side elevational view of a portion of a motorcycle powered by a crankcase compression, four-cycle, internal combustion engine constructed in accordance with a first embodiment of the invention, with portions of the motorcycle shown in phantom and with portions of the engine broken away and shown in cross-section.

Referring in detail initially to FIG. 1, an internal combustion engine of the crankcase compression, four-cycle type constructed in accordance with a first embodiment of the invention is identified generally by the reference numeral 11. This engine 11 is mounted within a motorcycle partially and in phantom and identified by the reference numeral 12.

Specifically, the engine 11 drives a change speed transmission 13 which has an output shaft 14. A sprocket 15 is affixed to this output shaft and drives a chain or belt 16, which, in turn, drives a rear wheel (not shown). The rear wheel is mounted at the trailing end of a trailing arm 17 that is journaled by means of a pivot pin 18 on a frame assembly 19 of the motorcycle 12.

The basic structure of the motorcycle 12 is not illustrated because it forms no part of the invention. The invention, however, has particular utility for powering units where space is at a premium and also where the engine is required to run over widely varying speed and road ranges. Also, the invention has particular utility where compact, high performance power systems are required since the engine 11 achieves this result it is illustrated in a motorcycle type application because this is one which is well suited to powered by an engine constructed in accordance with the invention.

The engine 11 includes a cylinder block 21 that forms one or more cylinder bores 22. A cylinder head assembly, indicated generally by the reference numeral 23 is affixed to the cylinder block 21 or, may be formed, in part, integrally therewith. The cylinder head assembly 23 has a recess 24 that cooperates with the cylinder bore 22 to form a combustion chamber. A piston 25, which is supported for reciprocation in the cylinder bore 22, completes this combustion chamber. Since the volume of the combustion chamber at top dead center position of the piston 25 is formed primarily by the cylinder head recess 24, at times this reference numeral will be utilized to refer to the combustion chamber.

Although the invention is illustrated in conjunction with a single cylinder engine, those skilled in the art will be readily able to understand how the invention can be employed with multi-cylinder engines of varying configurations.

The opposite end of the cylinder bore 22 is closed by a crankcase member, 26 which is affixed in any suitable manner to the cylinder block 21. The crankcase member 26, cylinder block 21 and piston 25 form a variable volume crankcase chamber, indicated by the reference numeral 27. A crankshaft indicated generally by the reference numeral 28 is rotatably journaled within the crankcase chamber 27 by a bearing arrangement which would be described later by reference to FIG. 4.

A connecting rod 29 is pivotally connected to the piston 26 by means of a piston 31 and is journaled on a throw 32 of the crankshaft 28 for transmitting reciprocation of the piston 25 into rotation of the crankshaft 28. The piston 25 and connecting rod 29 are configured so as to provide a seal therebetween in the manner described in aforenoted U.S. Pat. No. 5,377,634. In a like manner, the connecting rod 29, crankshaft 28 and crankcase 26 and cylinder block 21 are configured so as to provide a seal so that the crankcase chamber 27 is divided into an intake chamber formed on one side thereof and a compression chamber formed on the other side thereof At times, these chambers are separated from each other while at other portions of the stroke they are opened for communication with each other. This construction is also as described in aforenoted U.S. Pat. No. 5,377,634.

An intake charge is delivered to the combustion chamber 24 from an induction system, to be described later, through a cylinder head intake passage 33 that terminates in an intake valve seat 34 formed in the cylinder head recess 24. A poppet-type intake valve 35 is supported in the cylinder head assembly 23 and opens and closes this valve seat 34. This intake valve is urged toward its closed position by a coil compression spring assembly 36 in a well known manner. The intake valve 35 is opened by an intake rocker arm 37 that is journaled in the cylinder head assembly 23 on a rocker arm shaft 38.

An intake cam lobe of a camshaft 39 operates the rocker arm 37. The camshaft 39 is driven in timed relationship with a crankshaft 28 so as to rotate at one-half crankshaft speed, in any manner, as is well known in the four-cycle engine art.

A spark plug (not shown) is mounted in the cylinder head assembly 23 and fires the burnt charge in the combustion chamber 24 so as to drive the piston 25 in a well known manner. The spark plug is fired by a flywheel magneto arrangement, indicated generally at 40, as shown in FIG. 4

The burnt charge is discharged through an exhaust valve seat 41 into a cylinder head exhaust passage 42. This exhaust passage 42 communicates with the atmosphere through an exhaust system shown partially in phantom and indicated by the reference numeral 43.

A poppet-type exhaust valve is supported in the cylinder head 23 and opens and closes the exhaust valve seat 41. Like the intake valve 35, the exhaust valve 44 is urged towards its closed position by a coil compression spring assembly 45. An exhaust rocker arm 46 is pivotally mounted in the cylinder head assembly on a rocker arm shaft 47. Like the intake rocker arm 37, the exhaust rocker arm 46 is operated by a lobe on the camshaft 39.

Figure 2:
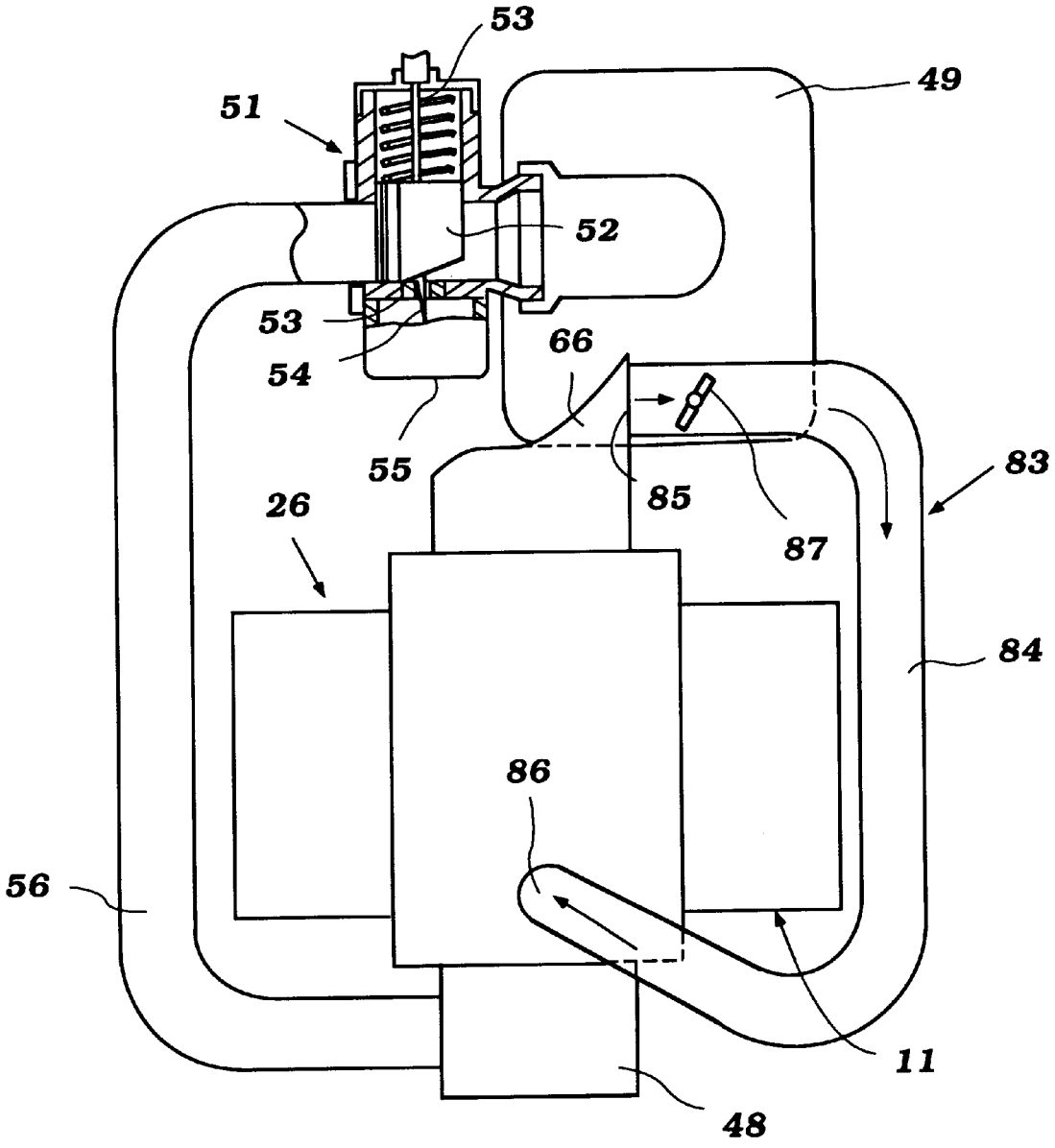
FIG. 2 is a view looking in another direction and partially schematically showing the control system for the supercharger pressure.
Figure 3:
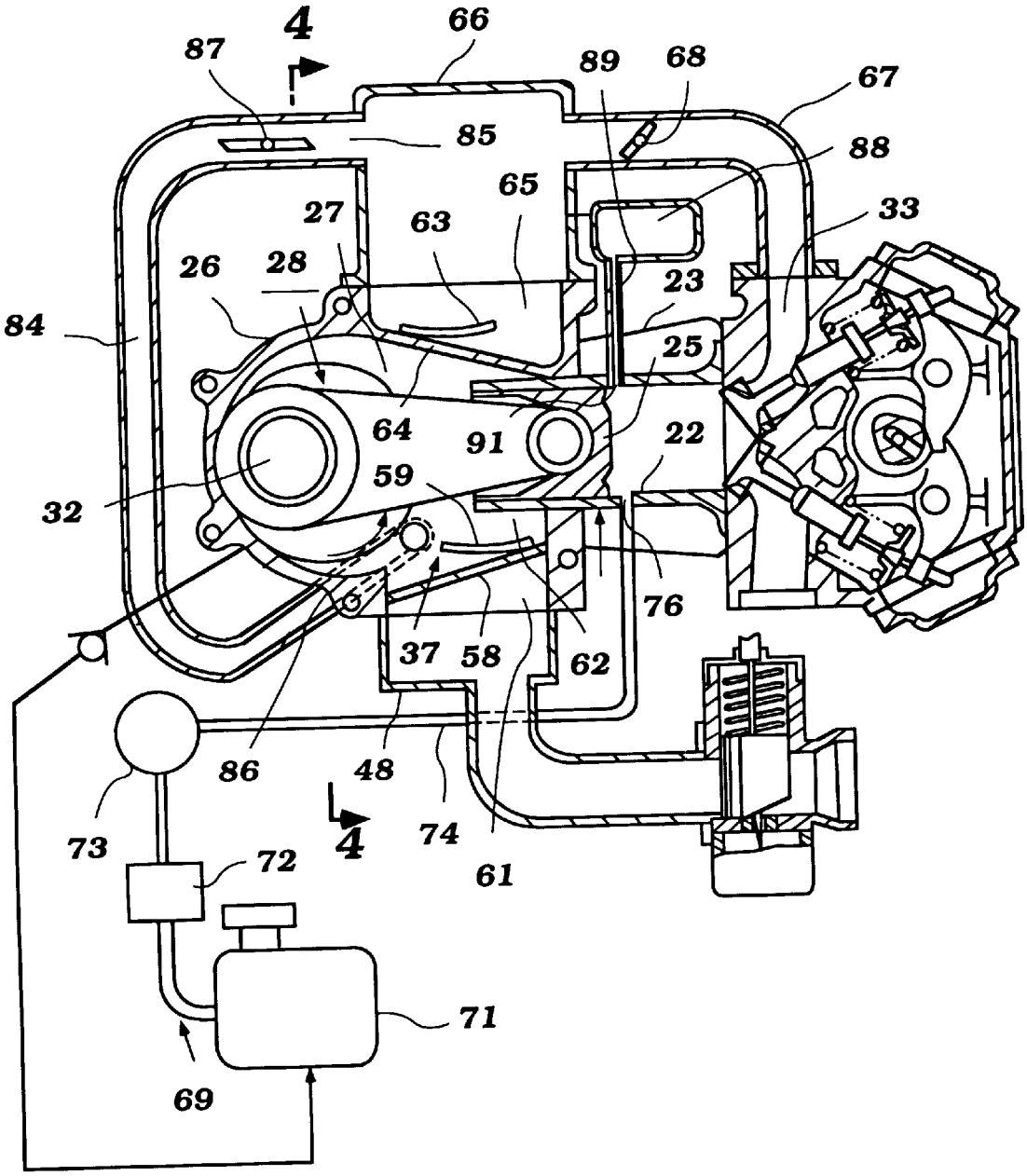
FIG. 3 is a cross-sectional view, in part similar to FIG. 1 but shows the components relocated in order to more clearly show their relationship.
Figure 4:
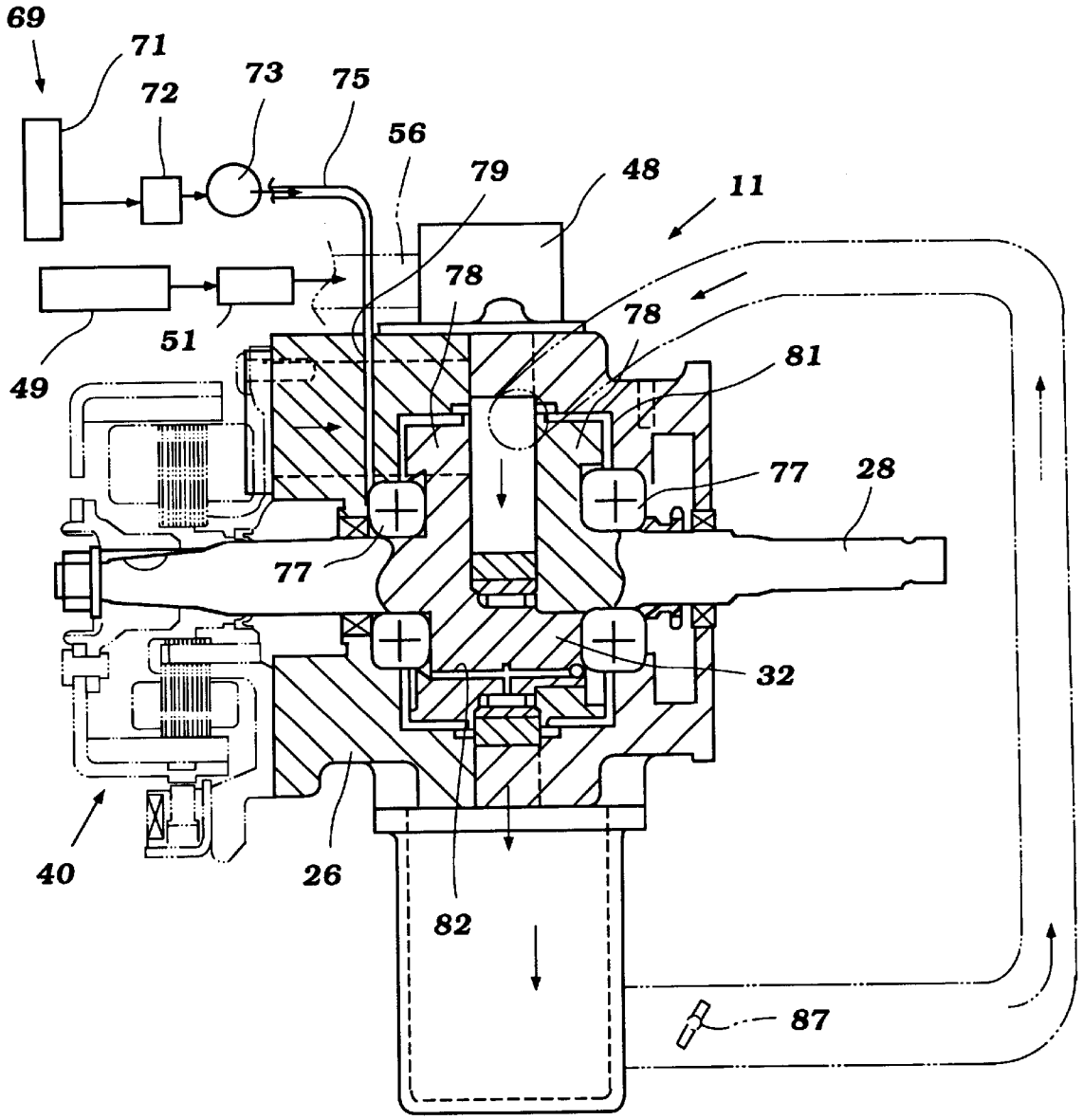
FIG. 4 is a cross-sectional view taken along the line 4—4 of Figure and shows the lubricating system for the crankshaft and associated components.

The induction system for supplying the charge to the cylinder head intake passage 35 is shown in most detail in FIGS. 2, 3 and 4, although its components also appear in FIG. 1. This induction system includes a first portion that supplies a fuel air charge, in this embodiment, to an induction box 48 that is affixed to the intake side of the crankcase member 26 in any suitable manner.

This portion of the induction system includes an air inlet device 49 which may include a silencing and filtering assembly and which draws air from the atmospheric. This atmospheric air is delivered from the air inlet device 49 to a charge former, indicated generally by the reference numeral 51, and which in this embodiment is comprised of a carburetor.

This carburetor 51 has a sliding piston throttle valve 52 that is operated by the operator of the motorcycle through a wire actuator 53. A metering rod 54 is connected for movement with the piston 52 and cooperates with a metering jet 53 to control the amount of fuel which flows into induction system from a fuel bowl 55 of the carburetor 51. Fuel is supplied to the fuel bowl 55 in any suitable manner.

This fuel air charge is then delivered through an intake pipe 56 to the induction box 48 on the intake side of the crankcase chamber 27.

A first flow control valve in the form of a reed-type valve, indicated generally by the reference numeral 57, controls the flow of air from the induction box 48 to the crankcase chamber 27. This reed-type valve 57 is comprised of a valve plate 58 which defines an opening, not shown, that is valved by a reed-type valve element 59. The valve element 59 permits flow from an area 61 upstream of the valve plate 58 to an area 62 downstream of the valve plate 58 and which is in open communication with the crankcase chamber 27.

As described in the aforenoted patent, during a portion of the piston stroke, a charge can enter the crankcase chamber 27 when the piston 25 is moving upwardly and the volume of the crankcase chamber 27 is increasing. This is accomplished through opening of the reed-type check valve element 59.

As the piston 25 moves toward bottom dead center, the lower end of the connecting rod 29 will engage a surface that defines the crankcase chamber 27 and trap the fluid on the upper or left-hand side of the connecting rod 29. This charge is then compressed as the piston moves downwardly toward its bottom dead center position and this charge will then begin to be expelled from the crankcase chamber 27 to the next portion of the induction system.

When this movement occurs, a second control valve, which also comprises a reed-type valve 63 will open a port 64 in the wall of the crankcase member 26 that communicates with a pressure chamber 65 formed by the crankcase member 26 and a pressure chamber forming member 66 that is affixed thereto. This charge can then flow through a pressure delivery passage 67 that communicates with the cylinder head intake passage 33. A further speed controlling throttle valve 68 is positioned in this pressure passage 67 to control the speed or output of the engine in a manner that will be described.

Inasmuch as the engine 11 utilizes the crankcase chamber 27 for a compressor, a separate lubricating system is provided for the engine. This separate lubricating system is indicated generally by the reference numeral 69 and includes a lubricant storage tank 71 in which a quantity of lubricating oil is contained. This oil flows through a filter 72 being drawn by a distributing pump 73 that pumps fluid through first and second delivery lines 74 and 75.

The line 74 extends to a location in the cylinder block 21 where it intersects the cylinder bore 22 at a discharge port 76. The discharge port 76 is disposed at an area where it will be in registry with the skirt of the piston 25 for substantially all of its stroke except immediately adjacent bottom dead center as seen in FIGS. 1 and 3. Thus, the piston skirt will be well lubricated.

The crankshaft 28 is lubricated by means of the conduit 75 as seen in FIG. 4. As may be seen in this figure, the crankcase member 26 carries a pair of spaced apart bearings 77 that journal the crankshaft 28 adjacent its cheeks 78. The conduit 75 intersects a passageway 79 which intersects one of the bearings 77 and a further passageway 81 that intersects the other bearing 77 for its lubrication.

In addition, cross-drillings 82 intersect the throw 32 so as to lubricate the bearings for the connecting rod 29. The connecting rod 29 may also be drilled to lubricate the piston pin 31.

Figure 5:
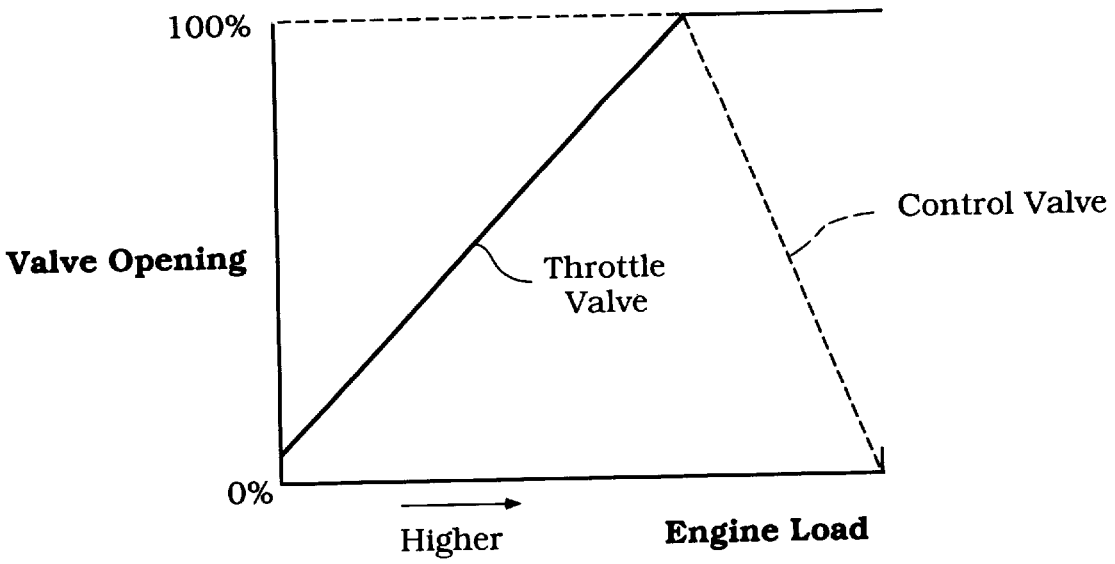
FIG. 5 is a graphical view showing the relationship between throttle valve opening, as shown in solid lines, and supercharger pressure control valve opening, as shown in phantom lines, to illustrate how the engine control is achieved.

The manner of controlling the speed of the engine 11 and its boost pressure will now be described by reference to all of the figures including FIG. 5. It will be seen that there is a pressure relief passage, indicated generally by the reference numeral 83 which consist primarily of conduit 84 that extends from the pressure chamber 66 through an inlet opening 85 to the crankcase chamber downstream of the check valve 57 via an opening 86. As may be seen in FIG. 3, this opening 86 is disposed in the valve housing area 62 but downstream of the check valve 57. Hence, the pressurized gases which are returned to relieve the pressure will not be able to escape to the atmosphere and will be delivered to the crankcase chamber 27 so as to reduce pumping losses. This also improves throttle response.

A supercharger pressure control valve, indicated by the reference numeral 87, is provided in this passageway so as to control the pressure and, accordingly, the speed or output of the engine 11. The way this is done is best understood by reference to FIG. 5 which shows the effect of the interconnection between the throttle control valve 68 and the supercharger pressure control valve 87. As may be seen, the throttle control valve 68 is partially at low speeds and loads. At this same time, the supercharger pressure control valve 87 is fully opened so that only atmospheric air pressure will be exerted in the intake system. As the load increases or the operator demands greater output from the engine, the throttle control valve 68 will be progressively opened. The throttle control valve 68 and the supercharger pressure control valve 87 are operated in response to the position of the carburetor throttle valve 52 through a linkage system. Alternatively they may be controlled by servo motors under a similar control strategy.

Eventually and before full power, the throttle control valve 68 will be fully opened. At this time, further power increases are achieved by the operator continuing to open the carburetor throttle valve 52 and then the operating connection will begin closing the supercharger pressure control valve 87 on a more abrupt line as seen on the right-hand side of FIG. 5. Thus, further boost will be accomplished for the engine 11 and its power output will increase. Thus, very effective throttle control is achieved by controlling the super charger bypassing and thus, pressure losses are avoided. In addition, the system permits the engine to be operated without the risk that fuel can be blown back to the atmosphere through the pressure relief in the compression system.

The engine 11 is also provided with an EGR system for reducing nitrous oxides ($NO_x$) in the exhaust discharge. This system includes an exhaust gas accumulator chamber 88 (FIGS. 1 and 3) that communicates with the cylinder bore 22 at a point slightly above the bottom dead center position of the piston 25. A conduit 89 from the exhaust gas accumulator chamber 88 terminates at a port 91 that opens into the cylinder bore 22 at this location.

It will be seen that the port 91 is slightly lower in the stroke than the lubricant port 76 and also as diametrically opposed to it. Furthermore, the conduit 89 extends generally vertically upwardly all of these features have a purpose which will be described shortly. Thus when the piston 25 reaches the bottom of its stroke during the expansion cycle, a small amount of exhaust gases can flow into the EGR accumulator chamber 88 through the restrictive port 91 and conduit 89. These gases will be trapped there when the piston 25 moves upwardly to perform the exhaust stroke.

As the piston 25 moves downwardly at the end of the intake stroke, the port 89 will be opened. Since the exhaust gases in the accumulator chamber 88 are at a higher than atmospheric pressure, some of them will flow back into the cylinder bore 22 to provide internal exhaust gas recirculation.

This communication will be terminated as the piston 25 moves toward its top dead center position on the compression stroke. Since the function of EGR and reduction of $NO_x$ emissions is well known, further description of this operation is not believed to be necessary to permit those skilled in those art to practice the invention.

However, it should be noted that the fact that the exhaust gas recirculation port 91 is well spaced from the lubrication port 76 any lubricant which passes around the skirt of the piston 25 will not likely enter the accumulator chamber 88 or the conduit 89. Also if lubricant is delivered when both ports 76 and 91 are opened the path is great enough to preclude this contamination. Also any lubricant which may enter the port 91 and conduit 89, will flow back by gravity and hence, lubricant will not be lost or carburized in the EGR system.

Figure 6:
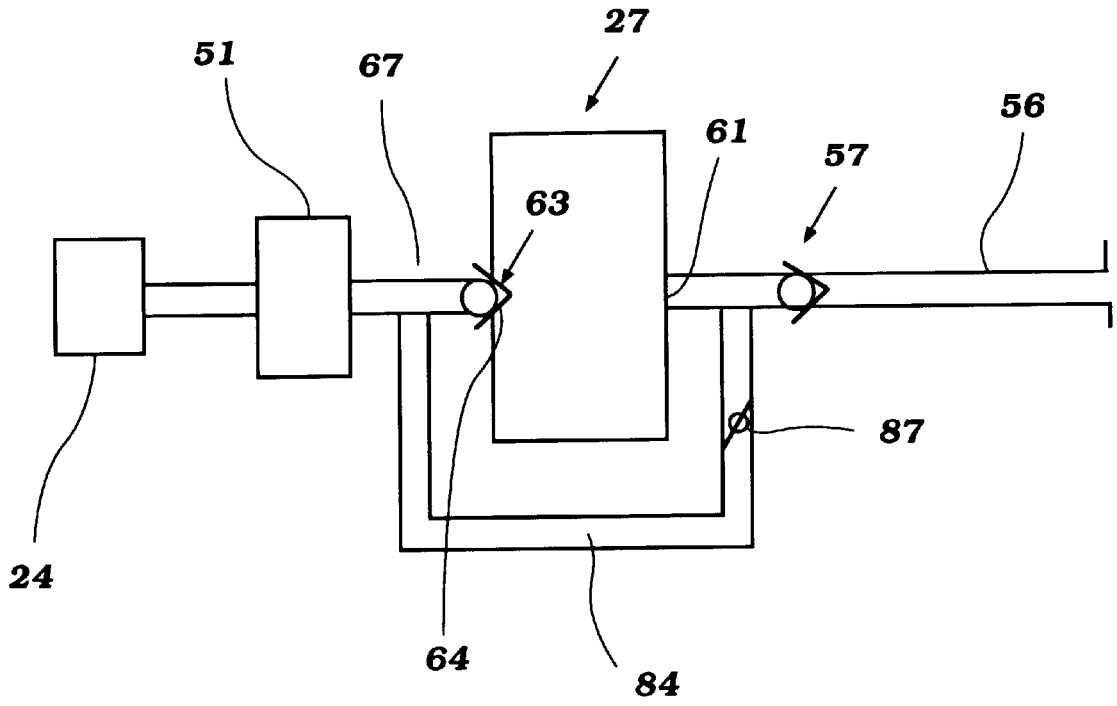
FIG. 6 is a partially schematic view showing another embodiment of the invention

As has been noted, this invention has particular utility in conjunction with arrangements wherein the charge former or carburetor is disposed on the inlet side to the crankcase compression chamber 27. However, the charge former or carburetor can be placed in other locations and, as seen in FIG. 6, the charge former 51 may be positioned in the conduit that connects the conduit 67 connecting the pressure chamber 66 with the combustion chamber or cylinder head intake passages 33. When this is done, the separate throttle control valve 68 can be eliminated because the throttle valve 52 of the carburetor will perform the flow controlling function and speed and road control.

Figure 7:
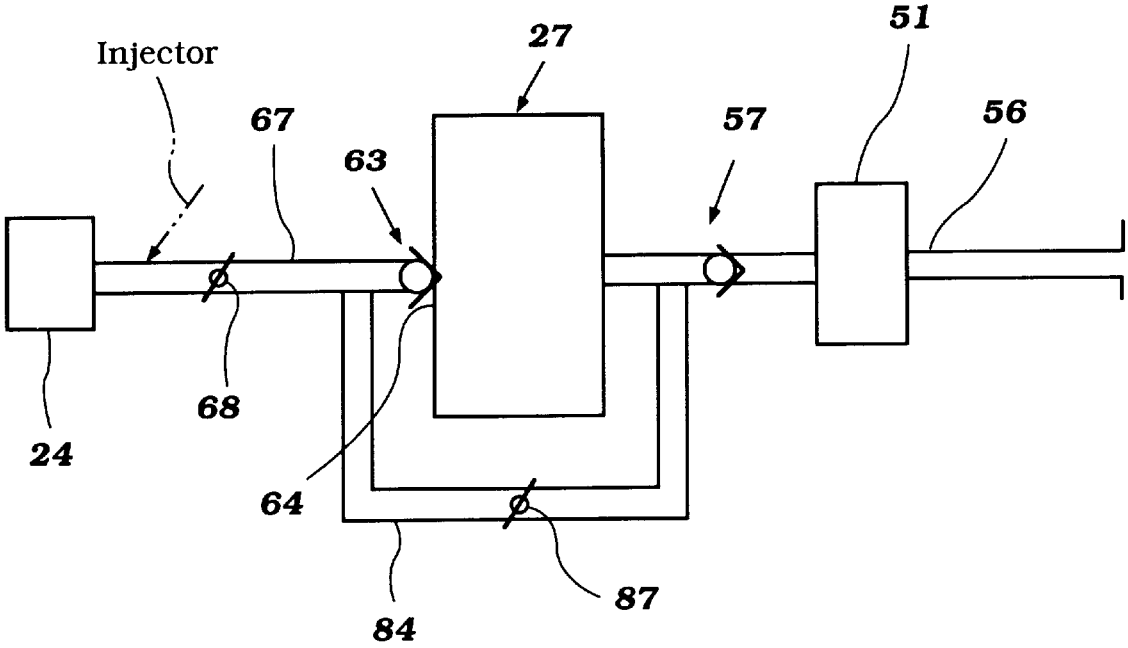
FIG. 7 is a partially schematic view showing a still further embodiment of the invention.

Also, the location of the supercharger pressure control valve 87 may be changed from adjacent the return to the crankcase chamber 27 as in the previous embodiments to a position closer to the pressure chamber 65 as seen FIG. 7. Also the carburetor 51 may be replaced by a manifold fuel injector as shown in phantom.

The EGR accumulator chamber port 91 in the previously described embodiment has been positioned generally diametrically opposite to the lubricating port 76. However and as previously described, the construction is such that it will be ensured that lubricant cannot likely enter the accumulator chamber port 91 during engine running.

Figure 8:
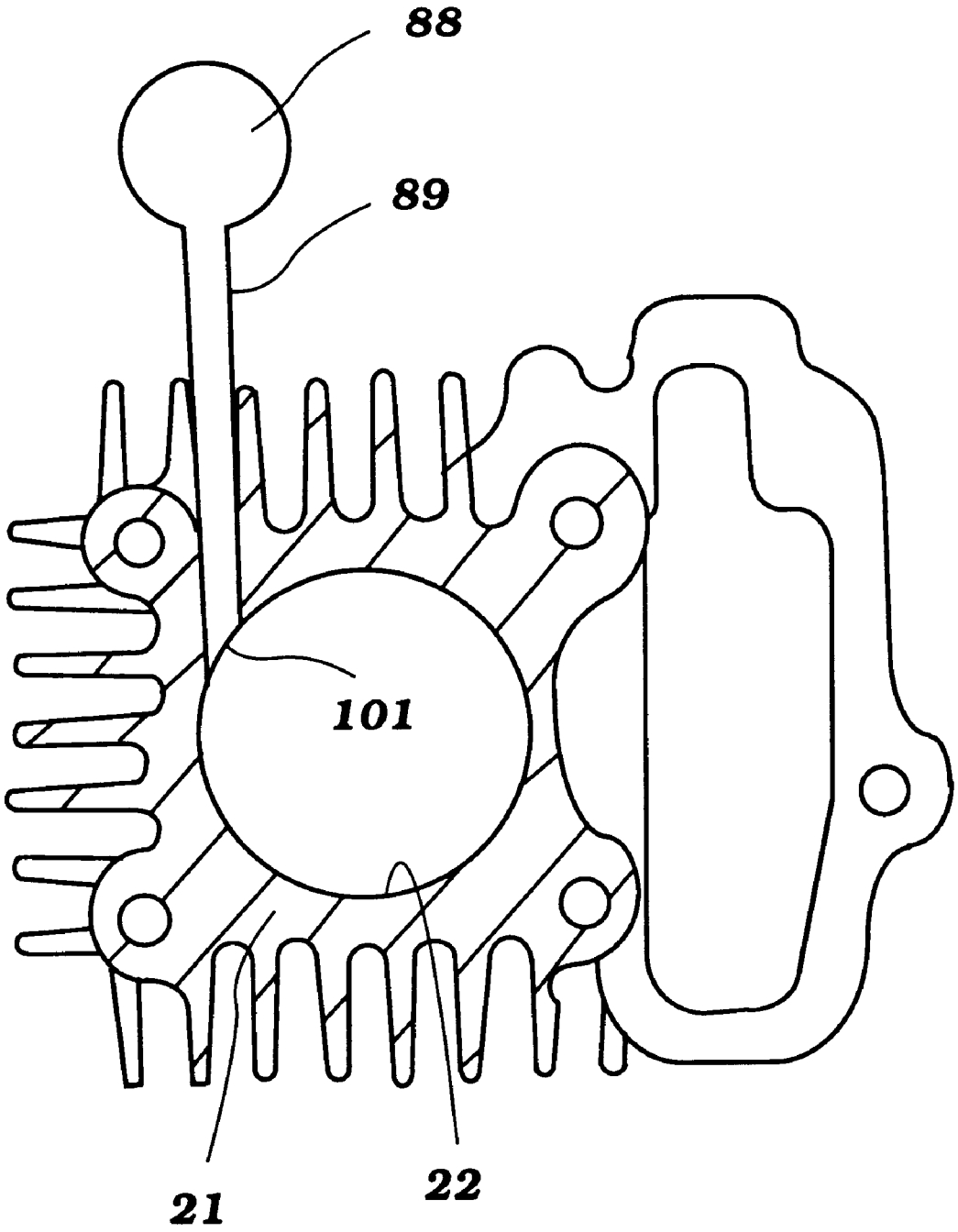
FIG. 8 is a cross-sectional view taken through a cylinder bore of an engine constructed in accordance with another embodiment of the invention.

FIG. 8 shows another embodiment wherein the accumulator chamber port, indicated by the reference numeral 101 is disposed still vertically above the lubricant port, which does not appear in this Figure, so that the accumulator chamber 88 and conduit 89 extend generally vertically upwardly. However, because the port 101 is disposed on the side of the cylinder bore, the EGR gases will be delivered back into the combustion chamber in a swirling direction that will tend to improve mixing with the incoming air charge so as to provide good mixing.

Figure 9:
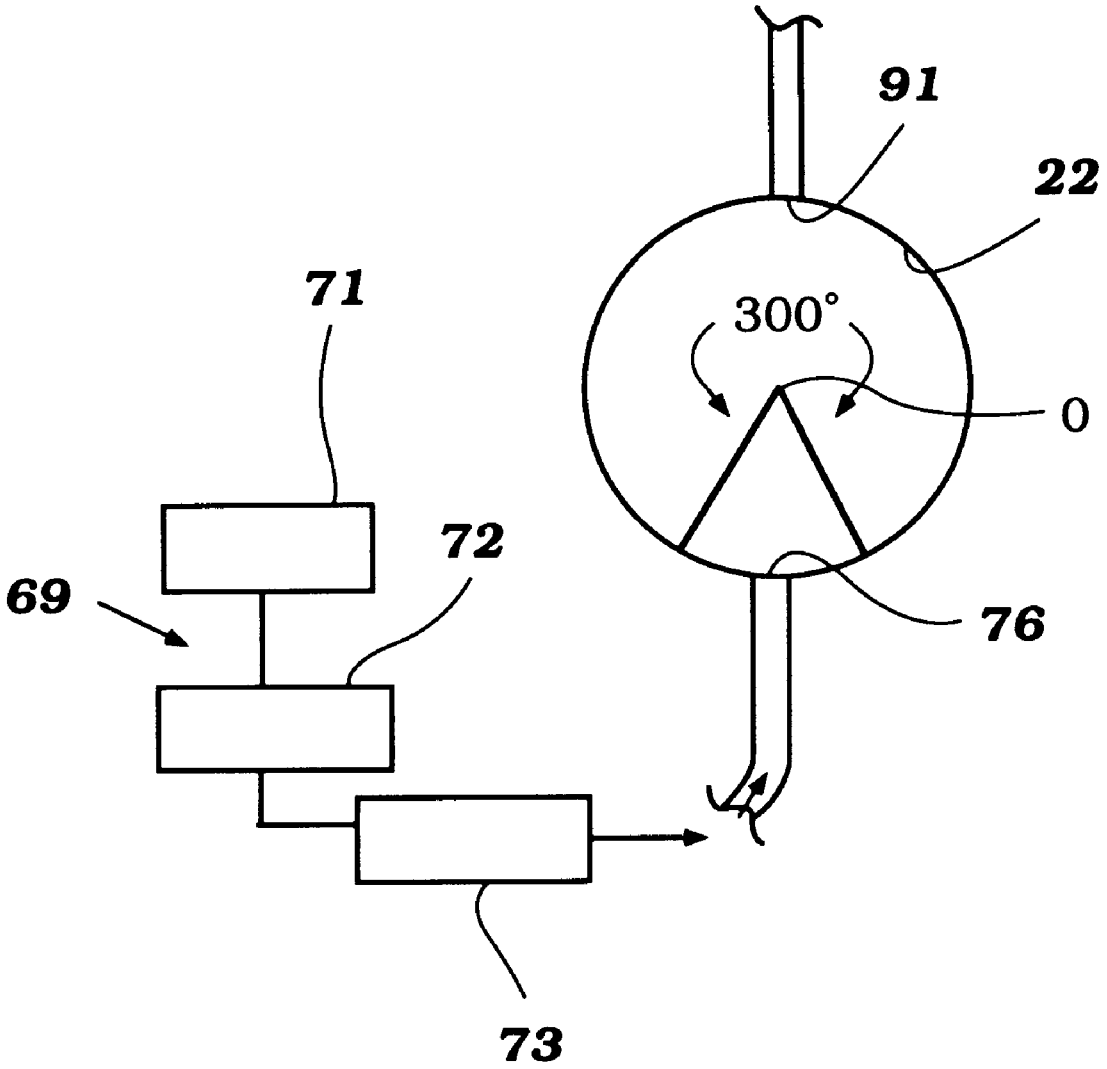
FIG. 9 is a partially schematic view showing a cross-section through a cylinder bore and explaining the potential locations for the accumulator chamber port in accordance with the embodiments of the invention.

FIG. 9 is another view that shows the potential areas where the accumulator chamber port 91 may be located without risk of interference or obtaining lubricant from the lubricating port 76. As long as this location is in the range of approximately 60° from the center of the lubricating port 76, there will be no likelihood of lubricant entering this port. Said another way, the port 91 may be located anywhere in the range shown by the arc having the legend 300° without risk of contamination.

Thus, from the foregoing description it should be readily apparent that the described embodiment provide very good power output control for the engine and commit a wider range of speed and load control to be accommodated while still permitting good throttle response and reducing company losses. Also, the likelihood of fuel being discharged to the atmosphere is substantially eliminated. Furthermore internal EGR is possible.

Of course, the foregoing description is that of the preferred embodiments of the invention and various changes and modifications may be made without departing from the spirit and scope of the invention, as defined by the appended claims.

I claim:

1. A four-cycle, crankcase compression, internal combustion engine comprised of a cylinder block defining at least one cylinder bore, a cylinder head affixed to said cylinder block in closing relation to one end of said cylinder bore and forming a combustion chamber with said cylinder bore, a crankcase member affixed to said cylinder block in closing relationship to the other end of said cylinder bore and forming a crankcase chamber with said cylinder block, a piston reciprocating in said cylinder bore and separating said combustion chamber from said crankcase chamber, a crankshaft rotatably journaled in said crankcase chamber, means for driving said crankshaft from the reciprocation of said piston, timed intake and exhaust valves for permitting a charge to enter said combustion chamber and to permit a burned charge to be discharged from said combustion chamber, atmospheric air intake means for delivering a atmospheric air charge to said crankcase chamber for compression therein, a first control valve for controlling the communication of the atmospheric air with said crankcase chamber so that air can only enter said crankcase chamber from said atmospheric air intake means, a second control valve for controlling the communication of said crankcase chamber with a pressure chamber for permitting a compressed charge to flow only from said crankcase chamber to said pressure chamber, a pressure passage communicating said pressure chamber with said intake valve, a supercharger bypass passage extending between said pressure chamber and said crankcase chamber at a point between said two control valves for controlling the maximum pressure in said pressure passage.

2. A four-cycle, crankcase compression, internal combustion engine as set forth in claim 1, further including a charge forming device for supplying fuel to said engine.

3. A four-cycle, crankcase compression, internal combustion engine as set forth in claim 2, wherein the charge forming device supplies fuel to the atmospheric air intake means.

4. A four-cycle, crankcase compression, internal combustion engine as set forth in claim 3, wherein the charge former includes a throttle valve.

5. A four-cycle, crankcase compression, internal combustion engine as set forth in claim 4, wherein a supercharger pressure control valve controls the flow through the supercharger bypass passage.

6. A four-cycle, crankcase compression, internal combustion engine as set forth in claim 5, wherein the throttle valve and said supercharger pressure control valve are operated in staged sequence.

7. A four-cycle, crankcase compression, internal combustion engine as set forth in claim 6, wherein the supercharger pressure control valve is maintained in a fully opened position when the throttle valve is moved from an idle position toward a fully opened position and the supercharger throttle control valve is thereafter progressively closed.

8. A four-cycle, crankcase compression, internal combustion engine as set forth in claim 3, further including a throttle valve in the pressure passage.

9. A four-cycle, crankcase compression, internal combustion engine as set forth in claim 8, wherein a supercharger pressure control valve controls the flow through the supercharger bypass passage.

10. A four-cycle, crankcase compression, internal combustion engine as set forth in claim 9, wherein the throttle valve and said supercharger pressure control valve are operated in staged sequence.

11. A four-cycle, crankcase compression, internal combustion engine as set forth in claim 10, wherein the supercharger pressure control valve is maintained in a fully opened position when the throttle valve is moved from an idle position toward a fully opened position and the supercharger throttle control valve is thereafter progressively closed.

12. A four-cycle, crankcase compression, internal combustion engine as set forth in claim 9, further including a primary, manually operated throttle valve in the atmospheric air inlet for controlling the flow therethrough.

13. A four-cycle, crankcase compression, internal combustion engine as set forth in claim 12, wherein the throttle valve and said supercharger pressure control valve are operated in staged sequence with the primary, manually operated throttle valve.

14. A four-cycle, crankcase compression, internal combustion engine as set forth in claim 13, wherein the supercharger pressure control valve is maintained in a fully opened position and the throttle valve is moved from an idle position toward a fully opened position when the primary, manually operated throttle valve is in its an idle position and the throttle valve is opened after the primary, manually operated throttle valve is opened from its idle position.

15. A four-cycle, crankcase compression, internal combustion engine as set forth in claim 1, wherein one of the control valves comprises a check valve.

16. A four-cycle, crankcase compression, internal combustion engine as set forth in claim 15, wherein both of the control valves comprise check valves.

17. A four-cycle, crankcase compression, internal combustion engine as set forth in claim 1, further including an exhaust gas recirculation accumulator chamber communicating with the combustion chamber through a port opening in the cylinder bore, said port opening being disposed in proximity to the bottom dead center position of the piston so that said exhaust gas recirculation accumulator chamber communicates with said combustion chamber only when said piston is at or near its bottom dead center position.

18. A four-cycle, crankcase compression, internal combustion engine as set forth in claim 17, wherein the exhaust gas recirculation accumulator chamber is positioned vertically above the port.

19. A four-cycle, crankcase compression, internal combustion engine as set forth in claim 17, further including pressure lubricating means for delivering lubricant to the piston through a lubricating port in the cylinder bore.

20. A four-cycle, crankcase compression, internal combustion engine as set forth in claim 19, wherein the lubricating port is spaced from the port that communicates the exhaust gas recirculation accumulator chamber with the cylinder bore.

21. A four-cycle, crankcase compression, internal combustion engine as set forth in claim 20, wherein the exhaust gas recirculation accumulator chamber is positioned vertically above the port which communicates it with the cylinder bore.

22. An EGR system for an internal combustion engine having a cylinder block that defines a cylinder bore closed at one end by a cylinder head, a piston reciprocating in said cylinder bore and forming with said cylinder bore and said cylinder head a variable volume chamber in which combustion occurs, pressure lubricating means for delivering lubricant to said piston through a lubricating port in said cylinder bore, and an exhaust gas recirculation accumulator chamber communicating with said combustion chamber through an exhaust gas recirculation port opening in said cylinder bore, said exhaust gas recirculation port opening being disposed vertically above the bottom dead center position of said piston so that said exhaust gas recirculation accumulator chamber communicates with said combustion chamber only when said piston is at or near its bottom dead center position, said lubricating port being spaced from said exhaust gas recirculation port along the axis of said cylinder bore.

23. An EGR system for an internal combustion engine as set forth in claim 22, wherein the exhaust gas recirculation accumulator chamber is positioned vertically above the port.

* * * * *